US007124831B2

(12) United States Patent
Turley et al.

(10) Patent No.: US 7,124,831 B2
(45) Date of Patent: Oct. 24, 2006

(54) RESIN IMPREGNATED CONTINUOUS FIBER PLUG WITH NON-METALLIC ELEMENT SYSTEM

(75) Inventors: Rocky A. Turley, Houston, TX (US); Craig Fishbeck, Houston, TX (US); Rami Al Oudat, Huntsville, TX (US); Patrick J. Zimmerman, Houston, TX (US); Charles D. Parker, Sugar Land, TX (US); Michael R. Niklasch, Big Spring, TX (US); William J. Eldridge, Cypress, TX (US); Roland Freihet, Edmonton (CA); William F. Hines, III, Houston, TX (US); Bill Murray, Alberdeen (GB)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 11/101,855

(22) Filed: Apr. 8, 2005

(65) Prior Publication Data

US 2005/0189104 A1 Sep. 1, 2005

Related U.S. Application Data

(63) Continuation of application No. 10/811,559, filed on Mar. 29, 2004, now abandoned, which is a continuation of application No. 09/893,505, filed on Jun. 27, 2001, now Pat. No. 6,712,153.

(51) Int. Cl.
*E21B 33/12* (2006.01)

(52) U.S. Cl. ..... 166/387; 166/382; 166/118; 166/134

(58) Field of Classification Search ..... 166/118, 166/120, 134, 138, 387
See application file for complete search history.

(56) References Cited

U.S. PATENT DOCUMENTS 1,342,780 A 6/1920 Vedder
1,512,621 A 10/1924 Packer
1,648,377 A 11/1927 Crowell (Continued)

FOREIGN PATENT DOCUMENTS

CA 1170988 A1 7/1984

(Continued)

OTHER PUBLICATIONS

"A World of Applications," Advanced Composites, Inc., Website address: http://www.advancecomposites.com, Salt Lake City, UT 84101, Copyright 1999, 18 pages.

(Continued)

*Primary Examiner*—Frank Tsay
(74) *Attorney, Agent, or Firm*—Patterson & Sheridan, LLP

(57) ABSTRACT

A non-metallic element system is provided which can effectively seal or pack-off an annulus under elevated temperatures. The element system can also resist high differential pressures without sacrificing performance or suffering mechanical degradation, and is considerably faster to drill-up than a conventional element system. In one aspect, the composite material comprises an epoxy blend reinforced with glass fibers stacked layer upon layer at about 30 to about 70 degrees. A downhole tool, such as a bridge plug, frac-plug, or packer, is also provided. The tool comprises a first and second support ring having one or more tapered wedges, a first and second expansion ring, and a sealing member disposed between the expansion rings and the support rings.

42 Claims, 6 Drawing Sheets

U.S. PATENT DOCUMENTS

| | | | | |
|---|---|---|---|---|
| 1,684,266 | A | 9/1928 | Fisher | |
| 2,043,225 | A | 6/1936 | Armentrout | |
| 2,084,611 | A | 6/1937 | Crickmer | |
| 2,092,042 | A | 9/1937 | Armentrout | |
| 2,134,749 | A | 11/1938 | Burt | |
| 2,155,129 | A | 4/1939 | Hall | |
| 2,160,804 | A | 5/1939 | Hall | |
| 2,171,049 | A | 8/1939 | Simmons | |
| 2,204,659 | A | 6/1940 | Burt | |
| 2,205,119 | A | 6/1940 | Hall | |
| 2,299,057 | A | 10/1942 | McClain | |
| 2,319,514 | A | 5/1943 | Penfield | |
| 2,331,185 | A | 10/1943 | Gordy | |
| 2,331,293 | A | 10/1943 | Ballard | |
| 2,479,394 | A | 8/1949 | Montgomery | |
| 2,589,506 | A | 3/1952 | Morrisett | |
| 2,605,846 | A | 8/1952 | Van Brunt | |
| 2,647,584 | A | 8/1953 | Baker | |
| 2,695,672 | A | 11/1954 | Lane | |
| 2,753,940 | A | 7/1956 | Bonner | |
| 2,778,430 | A | 1/1957 | Baker | |
| 2,780,294 | A | 2/1957 | Loomis | |
| 2,806,536 | A | 9/1957 | Baker | |
| 2,884,938 | A | 5/1959 | Hildebrandt | |
| 2,942,665 | A | 6/1960 | Davis | |
| 3,002,561 | A | 10/1961 | Baker | |
| 3,055,424 | A | 9/1962 | Allen | |
| 3,062,295 | A | 11/1962 | Hanes | |
| 3,087,548 | A | 4/1963 | Graham | |
| 3,094,169 | A | 6/1963 | Conrad | |
| 3,136,365 | A | 6/1964 | Carter | |
| 3,294,173 | A | 12/1966 | Hodges | |
| 3,298,440 | A | 1/1967 | Current | |
| 3,306,366 | A | 2/1967 | Muse | |
| 3,343,607 | A | 9/1967 | Current | |
| 3,356,140 | A | 12/1967 | Young | |
| 3,362,478 | A | 1/1968 | McReynolds | |
| 3,371,716 | A | 3/1968 | Current | |
| 3,497,002 | A | 2/1970 | Berryman | |
| 3,497,003 | A | 2/1970 | Berryman | |
| 3,506,067 | A | 4/1970 | Lebourg | |
| 3,513,511 | A | 5/1970 | Crickmer | |
| 3,529,667 | A | 9/1970 | Malone | |
| 3,530,934 | A | 9/1970 | Kisling | |
| 3,643,282 | A | 2/1972 | Lechene | |
| 3,667,817 | A * | 6/1972 | Kellner | 175/325.5 |
| 3,687,196 | A | 8/1972 | Mullins | |
| 3,710,862 | A | 1/1973 | Young | |
| 3,749,166 | A | 7/1973 | Young | |
| 3,799,260 | A | 3/1974 | Barrington | |
| 3,842,905 | A | 10/1974 | Morrisett | |
| 3,910,348 | A | 10/1975 | Pitts | |
| 4,067,358 | A | 1/1978 | Streich | |
| 4,103,498 | A | 8/1978 | Steinborn | |
| 4,151,875 | A | 5/1979 | Sullaway | |
| 4,153,108 | A | 5/1979 | Pounds | |
| 4,175,619 | A | 11/1979 | Davis | |
| 4,182,423 | A | 1/1980 | Ziebarth | |
| 4,190,111 | A | 2/1980 | Davis | |
| 4,190,112 | A | 2/1980 | Davis | |
| 4,300,631 | A | 11/1981 | Sainato | |
| 4,349,205 | A | 9/1982 | McGee | |
| 4,397,351 | A | 8/1983 | Harris | |
| 4,410,210 | A | 10/1983 | De Sivry | |
| 4,427,063 | A | 1/1984 | Skinner | |
| 4,520,870 | A | 6/1985 | Pringle | |
| 4,595,052 | A | 6/1986 | Kristiansen | |
| 4,611,658 | A | 9/1986 | Salerni | |
| 4,634,314 | A * | 1/1987 | Pierce | 405/224.2 |
| 4,665,978 | A | 5/1987 | Luke | |
| 4,669,540 | A | 6/1987 | Luoma | |
| 4,688,641 | A | 8/1987 | Knieriemen | |
| 4,700,954 | A | 10/1987 | Fischer | |
| 4,708,202 | A | 11/1987 | Sukup et al. | |
| 4,711,300 | A | 12/1987 | Wardlaw | |
| 4,720,113 | A | 1/1988 | Hertz, Jr. | |
| 4,730,835 | A | 3/1988 | Wilcox | |
| 4,753,444 | A | 6/1988 | Jackson | |
| 4,784,226 | A | 11/1988 | Wyatt | |
| 4,834,176 | A | 5/1989 | Renfroe, Jr. | |
| 4,834,184 | A | 5/1989 | Streich | |
| 4,836,279 | A | 6/1989 | Freeman | |
| 4,858,687 | A | 8/1989 | Watson | |
| 4,915,175 | A | 4/1990 | Mashaw, Jr. | |
| 4,928,760 | A | 5/1990 | Freitas | |
| 4,942,923 | A | 7/1990 | Geeting | |
| 4,977,958 | A | 12/1990 | Miller | |
| 5,078,211 | A | 1/1992 | Swineford | |
| 5,095,980 | A | 3/1992 | Watson | |
| 5,146,994 | A | 9/1992 | Pleasants | |
| 5,224,540 | A | 7/1993 | Streich et al. | |
| 5,226,492 | A | 7/1993 | Solaeche et al. | |
| 5,271,468 | A | 12/1993 | Streich et al. | |
| 5,390,737 | A | 2/1995 | Jacobi | |
| 5,540,279 | A | 7/1996 | Branch et al. | |
| 5,701,959 | A | 12/1997 | Hushbeck et al. | |
| 5,839,515 | A | 11/1998 | Yuan et al. | |
| 5,857,520 | A | 1/1999 | Mullen | |
| 5,884,699 | A | 3/1999 | Mullen | |
| 5,890,537 | A | 4/1999 | Lavaure | |
| 5,984,007 | A | 11/1999 | Yuan | |
| 6,167,963 | B1 | 1/2001 | McMahan et al. | |
| 6,220,349 | B1 | 4/2001 | Vargus | |
| 6,394,180 | B1 * | 5/2002 | Berscheidt et al. | 166/193 |
| 6,491,108 | B1 | 12/2002 | Slup et al. | |
| 6,578,633 | B1 | 6/2003 | Slup et al. | |
| 6,708,770 | B1 | 3/2004 | Slup et al. | |
| 6,712,153 | B1 | 3/2004 | Turley et al. | |
| 2004/0177952 | A1 | 9/2004 | Turley et al. | |
| 2004/0216868 | A1 | 11/2004 | Owen, Sr. et al. | |
| 2005/0121201 | A1 | 6/2005 | Turley et al. | |

FOREIGN PATENT DOCUMENTS

| | | | |
|---|---|---|---|
| CA | 2041270 | | 10/1991 |
| CA | 2071721 | | 12/1992 |
| DE | 1 921 014 | | 10/1970 |
| DE | 27 33 199 | A1 | 2/1979 |
| DE | 3325931 | C1 | 7/1984 |
| DE | 87 07 207.6 | | 11/1987 |
| DE | 87 07 208.4 | | 11/1987 |
| DE | 3621354 | A1 | 1/1988 |
| DE | 3700717 | A1 | 7/1988 |
| DE | 3704969 | A1 | 8/1988 |
| DE | 3625393 | C1 | 2/1992 |
| EP | 0 454 466 | A2 | 10/1991 |
| EP | 0 519 757 | A1 | 12/1992 |
| EP | 0 570 157 | A2 | 11/1993 |
| EP | 1 052 369 | A2 | 11/2000 |
| GB | 749731 | | 12/1953 |
| SU | 479868 | | 8/1975 |
| SU | 543730 | | 1/1977 |
| SU | 543732 | | 1/1977 |
| SU | 717273 | | 2/1980 |
| SU | 1399449 | A1 | 5/1988 |
| SU | 1416664 | A1 | 8/1988 |
| WO | WO 92/20899 | A1 | 11/1992 |

OTHER PUBLICATIONS

PCT International Search Report from International Application PCT/GB02/02706, dated Aug. 19, 2002.

* cited by examiner

RESIN IMPREGNATED CONTINUOUS FIBER PLUG WITH NON-METALLIC ELEMENT SYSTEM

CROSS-REFERENCE TO RELATED APPLICATIONS

This application is a continuation of co-pending U.S. patent application Ser. No. 10/811,559, filed on Mar. 29, 2004, which is a continuation of U.S. patent application Ser. No. 09/893,505, filed on Jun. 27, 2001, now U.S. Pat. No. 6,712,153. Both related applications are incorporated by reference herein.

BACKGROUND OF THE INVENTION

1. Field of the Invention

The present invention relates to a downhole non-metallic sealing element system. More particularly, the present invention relates to downhole tools such as bridge plugs, frac-plugs, and packers having a non-metallic sealing element system.

2. Background of the Related Art

An oil or gas well includes a wellbore extending into a well to some depth below the surface. Typically, the wellbore is lined with tubulars or casing to strengthen the walls of the borehole. To further strengthen the walls of the borehole, the annular area formed between the casing and the borehole is typically filled with cement to permanently set the casing in the wellbore. The casing is then perforated to allow production fluid to enter the wellbore and be retrieved at the surface of the well.

Downhole tools with sealing elements are placed within the wellbore to isolate the production fluid or to manage production fluid flow through the well. The tools, such as plugs or packers for example, are usually constructed of cast iron, aluminum, or other alloyed metals, but have a malleable, synthetic element system. An element system is typically made of a composite or synthetic rubber material which seals off an annulus within the wellbore to prevent the passage of fluids. The element system is compressed, thereby expanding radially outward from the tool to sealingly engage a surrounding tubular. For example, a bridge plug or frac-plug is placed within the wellbore to isolate upper and lower sections of production zones. By creating a pressure seal in the wellbore, bridge plugs and frac-plugs allow pressurized fluids or solids to treat an isolated formation.

FIG. 1 is a cross sectional view of a conventional bridge plug 50. The bridge plug 50 generally includes a metallic body 80, a synthetic sealing member 52 to seal an annular area between the bridge plug 50 and an inner wall of casing there-around (not shown), and one or more metallic slips 56, 61. The sealing member 52 is disposed between an upper metallic retaining portion 55 and a lower metallic retaining portion 60. In operation, axial forces are applied to the slip 56 while the body 80 and slip 61 are held in a fixed position. As the slip 56 moves down in relation to the body 80 and slip 61, the sealing member is actuated and the slips 56, 61 are driven up cones 55, 60. The movement of the cones and slips axially compress and radially expand the sealing member 52 thereby forcing the sealing portion radially outward from the plug to contact the inner surface of the well bore casing. In this manner, the compressed sealing member 52 provides a fluid seal to prevent movement of fluids across the bridge plug 50.

Like the bridge plug described above, conventional packers typically comprise a synthetic sealing element located between upper and lower metallic retaining rings. Packers are typically used to seal an annular area formed between two co-axially disposed tubulars within a wellbore. For example, packers may seal an annulus formed between production tubing disposed within wellbore casing. Alternatively, packers may seal an annulus between the outside of a tubular and an unlined borehole. Routine uses of packers include the protection of casing from pressure, both well and stimulation pressures, as well as the protection of the wellbore casing from corrosive fluids. Other common uses include the isolation of formations or leaks within a wellbore casing or multiple producing zones, thereby preventing the migration of fluid between zones. Packers may also be used to hold kill fluids or treating fluids within the casing annulus.

One problem associated with conventional element systems of downhole tools arises in high temperature and/or high pressure applications. High temperatures are generally defined as downhole temperatures above 200° F. and up to 450° F. High pressures are generally defined as downhole pressures above 7,500 psi and up to 15,000 psi. Another problem with conventional element systems occurs in both high and low pH environments. High pH is generally defined as less than 6.0, and low pH is generally defined as more than 8.0. In these extreme downhole conditions, conventional sealing elements become ineffective. Most often, the physical properties of the sealing element suffer from degradation due to extreme downhole conditions. For example, the sealing element may melt, solidify, or otherwise loose elasticity.

Yet another problem associated with conventional element systems of downhole tools arises when the tool is no longer needed to seal an annulus and must be removed from the wellbore. For example, plugs and packers are sometimes intended to be temporary and must be removed to access the wellbore. Rather than de-actuate the tool and bring it to the surface of the well, the tool is typically destroyed with a rotating milling or drilling device. As the mill contacts the tool, the tool is "drilled up" or reduced to small pieces that are either washed out of the wellbore or simply left at the bottom of the wellbore. The more metal parts making up the tool, the longer the milling operation takes. Metallic components also typically require numerous trips in and out of the wellbore to replace worn out mills or drill bits.

There is a need, therefore, for a non-metallic element system that will effectively seal an annulus at high temperatures and withstand high pressure differentials without experiencing physical degradation. There is also a need for a downhole tool made substantially of a non-metallic material that is easier and faster to mill.

SUMMARY OF THE INVENTION

A non-metallic element system is provided which can effectively seal or pack-off an annulus under elevated temperatures. The element system can also resist high differential pressures as well as high and low pH environments without sacrificing performance or suffering mechanical degradation. Further, the non-metallic element system will drill up considerably faster than a conventional element system that contains metal.

The element system comprises a non-metallic, composite material that can withstand high temperatures and high pressure differentials. In one aspect, the composite material comprises an epoxy blend reinforced with glass fibers stacked layer upon layer at about 30 to about 70 degrees.

A downhole tool, such as a bridge plug, frac-plug, or packer, is also provided that consists essentially of a non-metallic, composite material which is easier and faster to mill than a conventional bridge plug containing metallic parts. In one aspect, the tool comprises a non-metallic element system, comprising a first and second support ring having one or more tapered wedges, a first and second expansion ring, and a sealing member disposed between the expansion rings and the support rings.

A method is further provided for sealing an annulus in a wellbore. In one aspect, the method comprises running a body into the wellbore, the body comprising a non-metallic sealing system having a first and second support ring, a first and second expansion ring, and a sealing member disposed between the expansion rings and the support rings, wherein the support ring comprises one or more tapered wedges. The method further comprises expanding the one or more tapered wedges to engage an inner surface of a surrounding tubular, and flowing the expansion ring to fill voids between the expanded wedges.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

A non-metallic element system that is capable of sealing an annulus in very high or low pH environments as well as at elevated temperatures and high pressure differentials is provided. The non-metallic element system is made of a fiber reinforced polymer composite that is compressible and expandable or otherwise malleable to create a permanent set position.

The composite material is constructed of a polymeric composite that is reinforced by a continuous fiber such as glass, carbon, or aramid, for example. The individual fibers are typically layered parallel to each other, and wound layer upon layer. However, each individual layer is wound at an angle of about 30 to about 70 degrees to provide additional strength and stiffness to the composite material in high temperature and pressure downhole conditions. The tool mandrel is preferably wound at an angle of 30 to 55 degrees, and the other tool components are preferably wound at angles between about 40 and about 70 degrees. The difference in the winding phase is dependent on the required strength and rigidity of the overall composite material.

The polymeric composite is preferably an epoxy blend. However, the polymeric composite may also consist of polyurethanes or phenolics, for example. In one aspect, the polymeric composite is a blend of two or more epoxy resins. Preferably, the composite is a blend of a first epoxy resin of bisphenol A and epichlorohydrin and a second cycoaliphatic epoxy resin. Preferably, the cycloaphatic epoxy resin is Araldite® liquid epoxy resin, commercially available from Ciba Geigy Corporation of Brewster, N.Y. A 50:50 blend by weight of the two resins has been found to provide the required stability and strength for use in high temperature and pressure applications. The 50:50 epoxy blend also provides good resistance in both high and low pH environments.

The fiber is typically wet wound, however, a prepreg roving can also be used to form a matrix. A post cure process is preferable to achieve greater strength of the material. Typically, the post cure process is a two stage cure consisting of a gel period and a cross linking period using an anhydride hardener, as is commonly know in the art. Heat is added during the curing process to provide the appropriate reaction energy which drives the cross-linking of the matrix to completion. The composite may also be exposed to ultraviolet light or a high-intensity electron beam to provide the reaction energy to cure the composite material.

Figure 1:
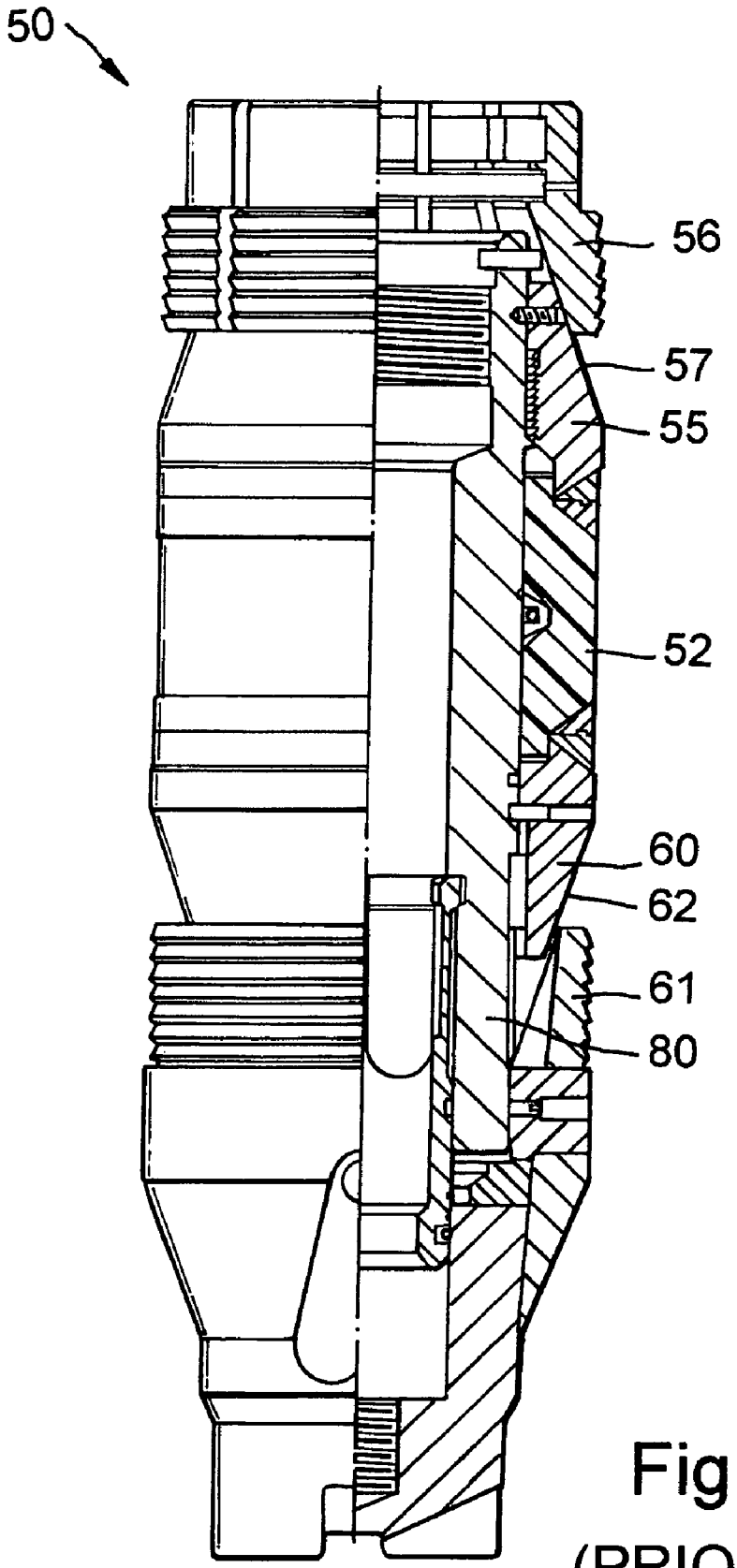
Fig.1 (PRIOR ART)
FIG. 1 is a partial section view of a conventional bridge plug.
Figure 2:
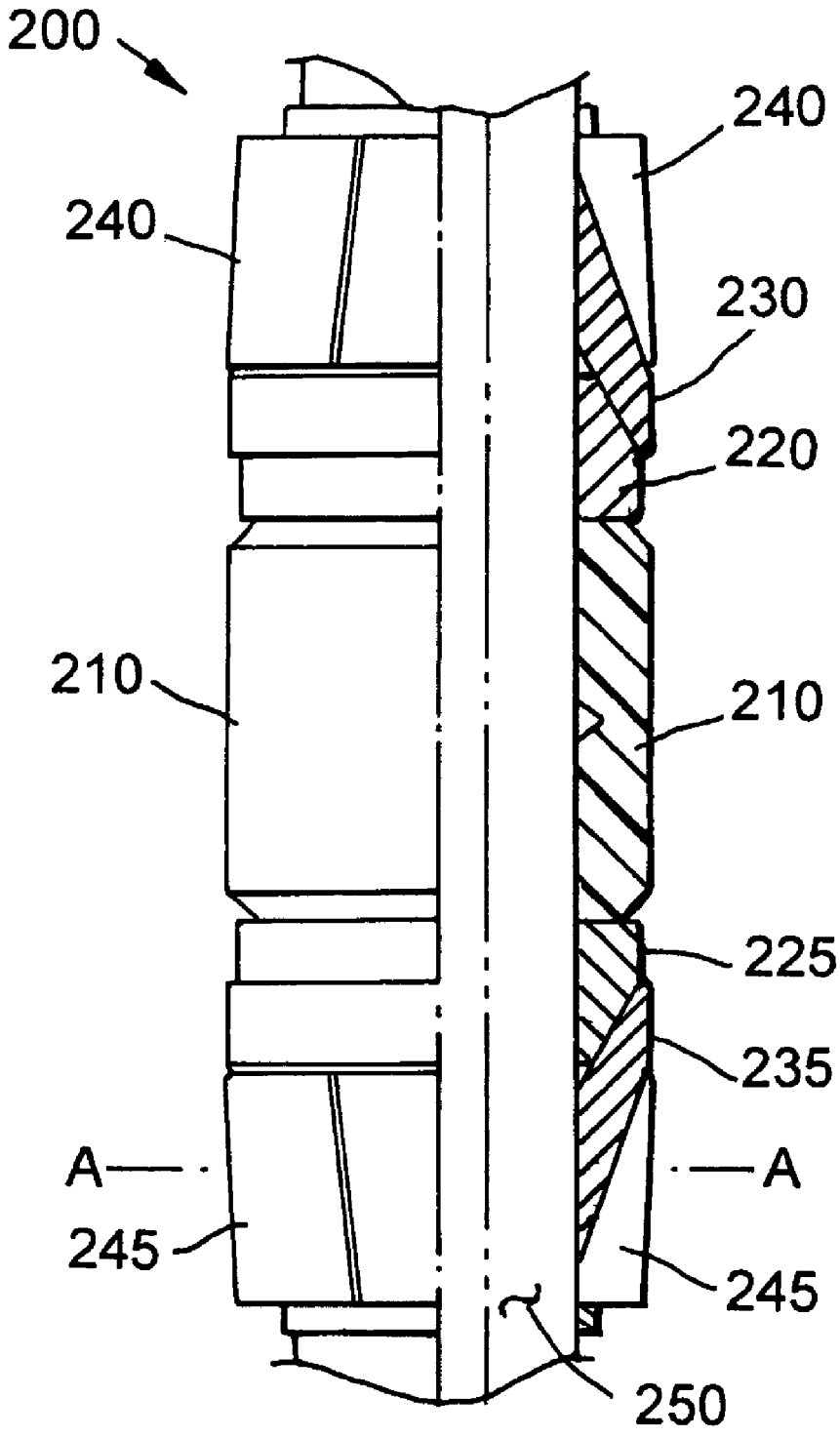
FIG. 2 is a partial section view of a non-metallic sealing system of the present invention.

FIG. 2 is a partial cross section of a non-metallic element system 200 made of the composite, filament wound material described above. The element system 200 includes a sealing member 210, a first and second cone 220, 225, a first and second expansion ring 230, 235, and a first and second support ring 240, 245 disposed about a body 250. The sealing member 210 is backed by the cones 220, 225. The expansion rings 230, 235 are disposed about the body 250 between the cones 220, 225, and the support rings 240, 245, as shown in FIG. 2.

Figure 3:
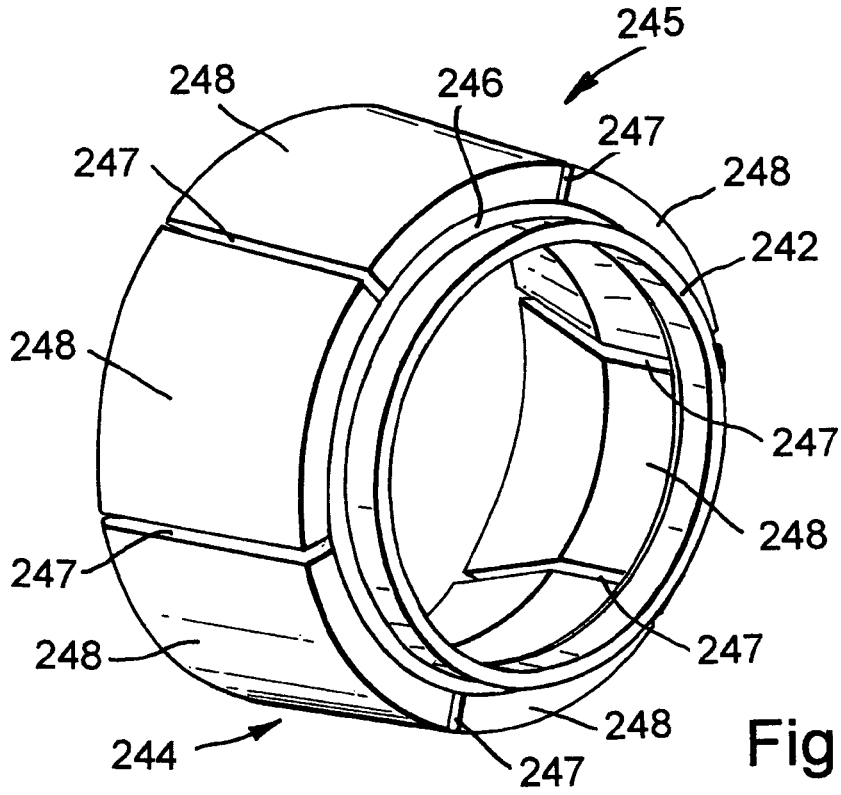
FIG. 3 is an enlarged isometric view of a support ring of the non-metallic sealing system.
Figure 4:
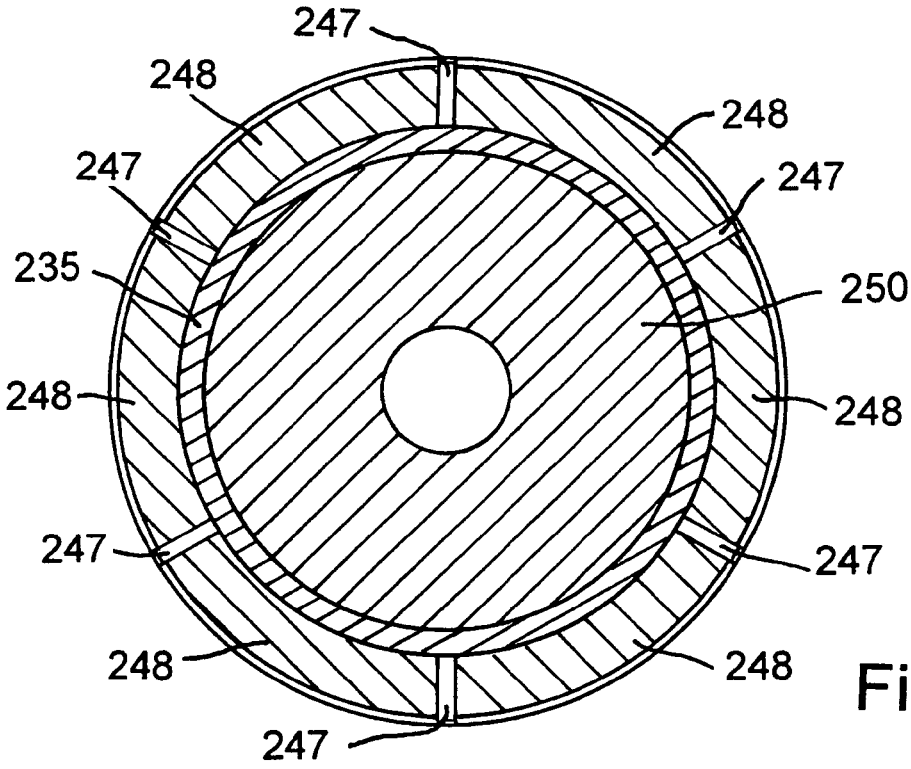
FIG. 4 is a cross sectional view along lines A—A of FIG. 2.

FIG. 3 is an isometric view of the support ring 240, 245. As shown, the support ring 240, 245 is an annular member having a first section 242 of a first diameter that steps up to a second section 244 of a second diameter. An interface or shoulder 246 is therefore formed between the two sections 242, 244. Equally spaced longitudinal cuts 247 are fabricated in the second section to create one or more fingers or wedges 248 there-between. The number of cuts 247 is determined by the size of the annulus to be sealed and the forces exerted on the support ring 240, 245.

Still referring to FIG. 3, the wedges 248 are angled outwardly from a center line or axis of the support ring 240, 245 at about 10 degrees to about 30 degrees. As will be explained below in more detail, the angled wedges 248 hinge radially outward as the support ring 240, 245 moves axially across the outer surface of the expansion ring 230, 235. The wedges 248 then break or separate from the first section 242, and are extended radially to contact an inner diameter of the surrounding tubular (not shown). This radial extension allows the entire outer surface area of the wedges 248 to contact the inner wall of the surrounding tubular. Therefore, a greater amount of frictional force is generated against the surrounding tubular. The extended wedges 248 thus generate a "brake" that prevents slippage of the element system 200 relative to the surrounding tubular.

Referring again to FIG. 2, the expansion ring 230, 235 may be manufactured from any flexible plastic, elastomeric, or resin material which flows at a predetermined temperature, such as Teflon® for example. The second section 244 of the support ring 240, 245 is disposed about a first section of the expansion ring 230, 235. The first section of the expansion ring 230, 235 is tapered corresponding to a complimentary angle of the wedges 248. A second section of the expansion ring 230, 235 is also tapered to compliment a slopped surface of the cone 220, 225. At high temperatures, the expansion ring 230, 235 expands radially outward from the body 250 and flows across the outer surface of the body 250. As will be explained below, the expansion ring 230, 235 fills the voids created between the cuts 247 of the support ring 240, 245, thereby providing an effective seal.

The cone 220, 225 is an annular member disposed about the body 250 adjacent each end of the sealing member 210. The cone 220, 225 has a tapered first section and a substantially flat second section. The second section of the cone 220, 225 abuts the substantially flat end of the sealing member 210. As will be explained in more detail below, the tapered first section urges the expansion ring 230, 235 radially outward from the body 250 as the element system 200 is activated. As the expansion ring 230, 235 progresses across the tapered first section and expands under high temperature and/or pressure conditions, the expansion ring 230, 235 creates a collapse load on the cone 220, 225. This collapse load holds the cone 220, 225 firmly against the body 250 and prevents axial slippage of the element system 200 components once the element system 200 has been activated in the wellbore. The collapse load also prevents the cones 220, 225 and sealing member 210 from rotating during a subsequent mill up operation.

The sealing member 210 may have any number of configurations to effectively seal an annulus within the wellbore. For example, the sealing member 210 may include grooves, ridges, indentations, or protrusions designed to allow the sealing member 210 to conform to variations in the shape of the interior of a surrounding tubular (not shown). The sealing member 210, however, should be capable of withstanding temperatures up to 450° F., and pressure differentials up to 15,000 psi.

In operation, opposing forces are exerted on the element system 200 which causes the malleable outer portions of the body 250 to compress and radially expand toward a surrounding tubular. A force in a first direction is exerted against a first surface of the support ring 240. A force in a second direction is exerted against a first surface of the support ring 245. The opposing forces cause the support rings 240, 245 to move across the tapered first section of the expansion rings 230, 235. The first section of the support rings 240, 245 expands radially from the mandrel 250 while the wedges 248 hinge radially toward the surrounding tubular. At a pre-determined force, the wedges 248 will break away or separate from the first section 242 of the support rings 240, 245. The wedges 248 then extend radially outward to engage the surrounding tubular. The compressive force causes the expansion rings 230, 235 to flow and expand as they are forced across the tapered section of the cones 220, 225. As the expansion rings 230, 235 flow and expand, they fill the gaps or voids between the wedges 248 of the support rings 240, 245. The expansion of the expansion rings 230, 235 also applies a collapse load through the cones 220, 225 on the body 250, which helps prevent slippage of the element system 200 once activated. The collapse load also prevents the cones 220, 225 and sealing member 210 from rotating during the mill up operation which significantly reduces the required time to complete the mill up operation. The cones 220, 225 then transfer the axial force to the sealing member 210 to compress and expand the sealing member 210 radially. The expanded sealing member 210 effectively seals or packs off an annulus formed between the body 250 and an inner diameter of a surrounding tubular.

The non-metallic element system 200 can be used on either a metal or more preferably, a non-metallic mandrel. The non-metallic element system 200 may also be used with a hollow or solid mandrel. For example, the non-metallic element system 200 can be used with a bridge plug or frac-plug to seal off a wellbore or the element system may be used with a packer to pack-off an annulus between two tubulars disposed in a wellbore. For simplicity and ease of description however, the non-metallic element system will now be described in reference to a frac-plug for sealing off a well bore.

Figure 5:
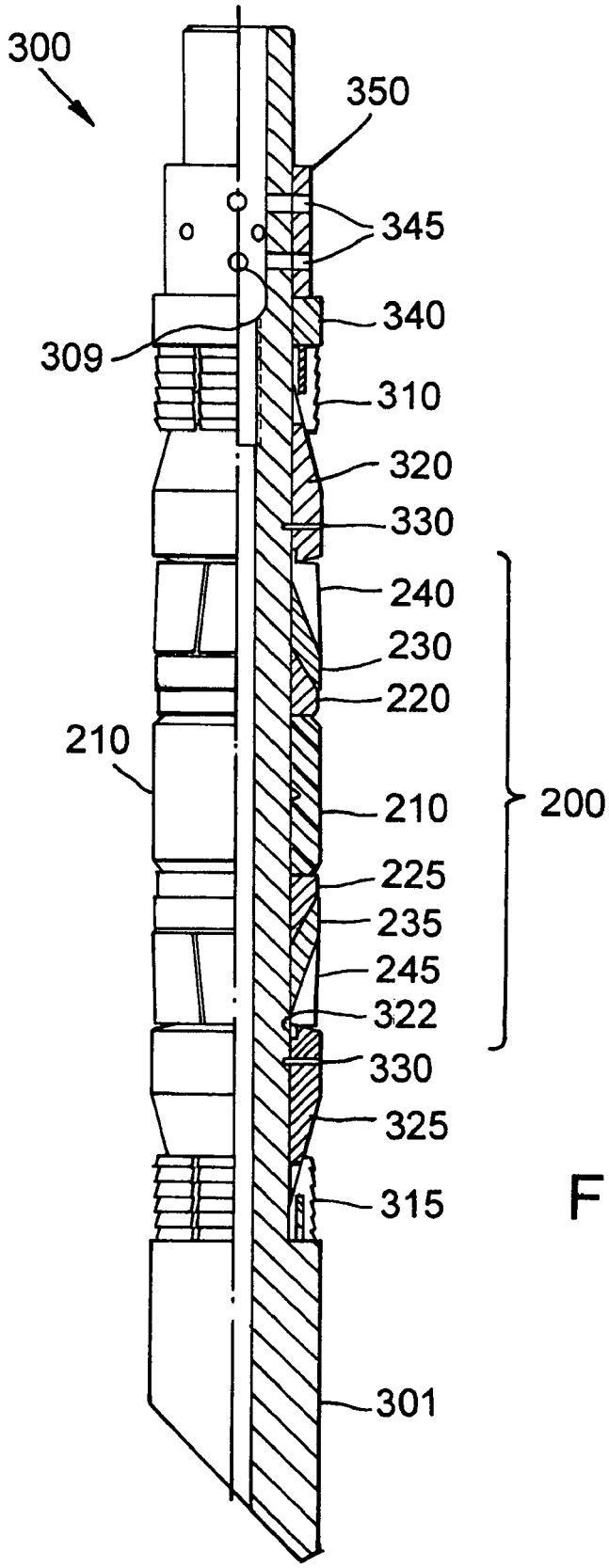
FIG. 5 is partial section view of a frac-plug having a non-metallic sealing system of the present invention in a run-in position.

FIG. 5 is a partial cross section of a frac-plug 300 having the non-metallic element system 200 described above. In addition to the non-metallic element system 200, the frac-plug 300 includes a mandrel 301, slips 310, 315, and cones 320, 325. The non-metallic element system 200 is disposed about the mandrel 301 between the cones 320, 325. The mandrel 301 is a tubular member having a ball 309 disposed therein to act as a check valve by allowing flow through the mandrel 301 in only a single axial direction.

The slips 310, 315 are disposed about the mandrel 302 adjacent a first end of the cones 320, 325. Each slip 310, 315 comprises a tapered inner surface conforming to the first end of the cone 320, 325. An outer surface of the slip 310, 315, preferably includes at least one outwardly extending serration or edged tooth, to engage an inner surface of a surrounding tubular (not shown) when the slip 310, 315 is driven radially outward from the mandrel 301 due to the axial movement across the first end of the cones 320, 325 thereunder.

The slip 310, 315 is designed to fracture with radial stress. The slip 310, 315 typically includes at least one recessed groove (not shown) milled therein to fracture under stress allowing the slip 310, 315 to expand outwards to engage an inner surface of the surrounding tubular. For example, the slip 310, 315 may include four sloped segments separated by equally spaced recessed grooves to contact the surrounding tubular, which become evenly distributed about the outer surface of the mandrel 301.

The cone 320, 325 is disposed about the mandrel 301 adjacent the non-metallic sealing system 200 and is secured to the mandrel 301 by a plurality of shearable members 330 such as screws or pins. The shearable members 330 may be fabricated from the same composite material as the non-metallic sealing system 200, or the shearable members may be of a different kind of composite material or metal. The cone 320, 325 has an undercut 322 machined in an inner surface thereof so that the cone 320, 325 can be disposed about the first section 242 of the support ring 240, 245, and butt against the shoulder 246 of the support ring 240, 245.

As stated above, the cones 320, 325 comprise a tapered first end which rests underneath the tapered inner surface of the slips 310, 315. The slips 310, 315 travel about the tapered first end of the cones 320, 325, thereby expanding radially outward from the mandrel 301 to engage the inner surface of the surrounding tubular.

A setting ring 340 is disposed about the mandrel 301 adjacent a first end of the slip 310. The setting ring 340 is an annular member having a first end that is a substantially flat surface. The first end serves as a shoulder which abuts a setting tool described below.

A support ring 350 is disposed about the mandrel 301 adjacent a first end of the setting ring 340. A plurality of pins 345 secure the support ring 350 to the mandrel 301. The support ring 350 is an annular member and has a smaller outer diameter than the setting ring 340. The smaller outer diameter allows the support ring 350 to fit within the inner diameter of a setting tool so the setting tool can be mounted against the first end of the setting ring 340.

The frac-plug 300 may be installed in a wellbore with some non-rigid system, such as electric wireline or coiled tubing. A setting tool, such as a Baker E-4 Wireline Setting Assembly commercially available from Baker Hughes, Inc., for example, connects to an upper portion of the mandrel 301. Specifically, an outer movable portion of the setting tool is disposed about the outer diameter of the support ring 350, abutting the first end of the setting ring 340. An inner portion of the setting tool is fastened about the outer diameter of the support ring 350. The setting tool and frac-plug 300 are then run into the well casing to the desired depth where the frac-plug 300 is to be installed.

Figure 6:
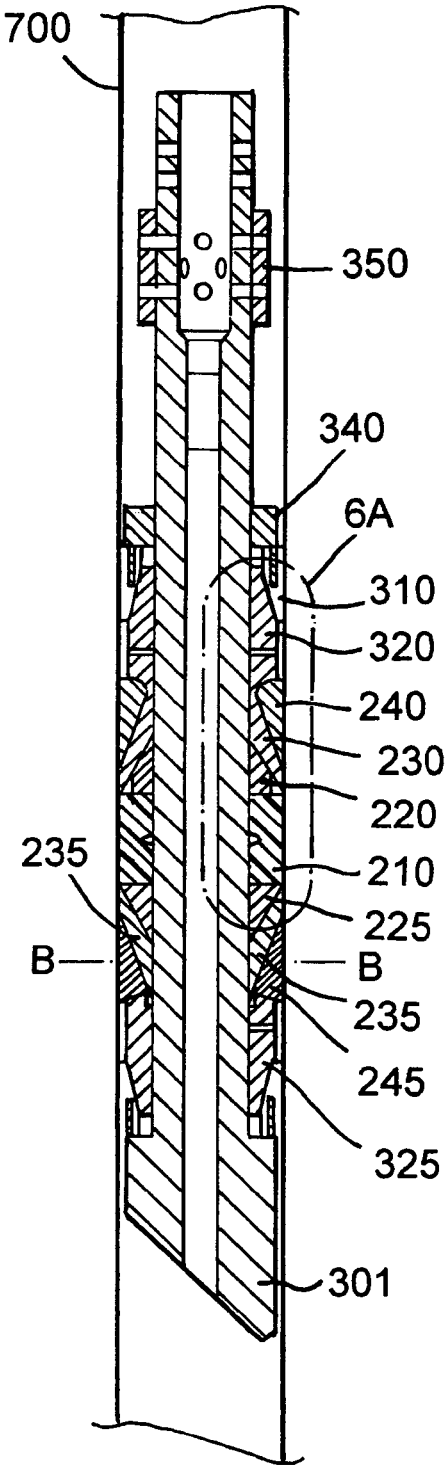
FIG. 6 is section view of a frac-plug having a non-metallic sealing system of the present invention in a set position within a wellbore.
Figure 6A:
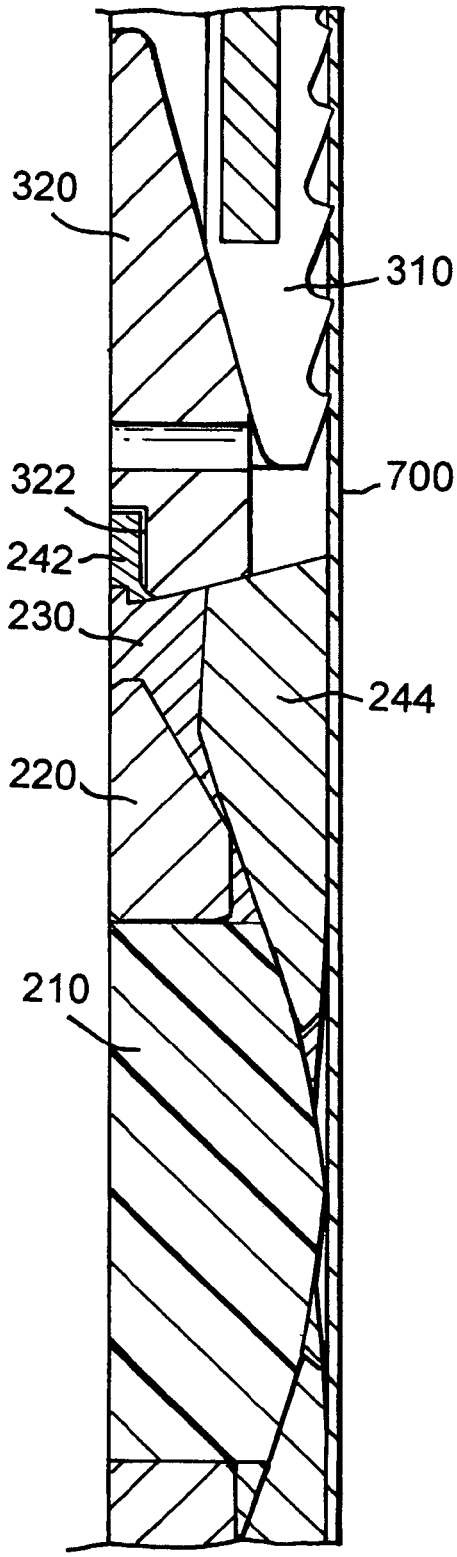
FIG. 6A is an enlarged view of a non-metallic sealing system activated within a wellbore.

To set or activate the frac-plug 300, the mandrel 301 is held by the wireline, through the inner portion of the setting tool, as an axial force is applied through the outer movable portion of the setting tool to the setting ring 340. The axial forces cause the outer portions of the frac-plug 300 to move axially relative to the mandrel 301. FIGS. 6 and 6A show a section view of a frac-plug having a non-metallic sealing system of the present invention in a set position within a wellbore.

Referring to both FIGS. 6 and 6A, the force asserted against the setting ring 340 transmits force to the slips 310, 315 and cones 320, 325. The slips 310, 315 move up and across the tapered surface of the cones 320, 325 and contact an inner surface of a surrounding tubular 700. The axial and radial forces applied to slips 310, 315 causes the recessed grooves to fracture into equal segments, permitting the serrations or teeth of the slips 310, 315 to firmly engage the inner surface of the surrounding tubular.

Figure 7:
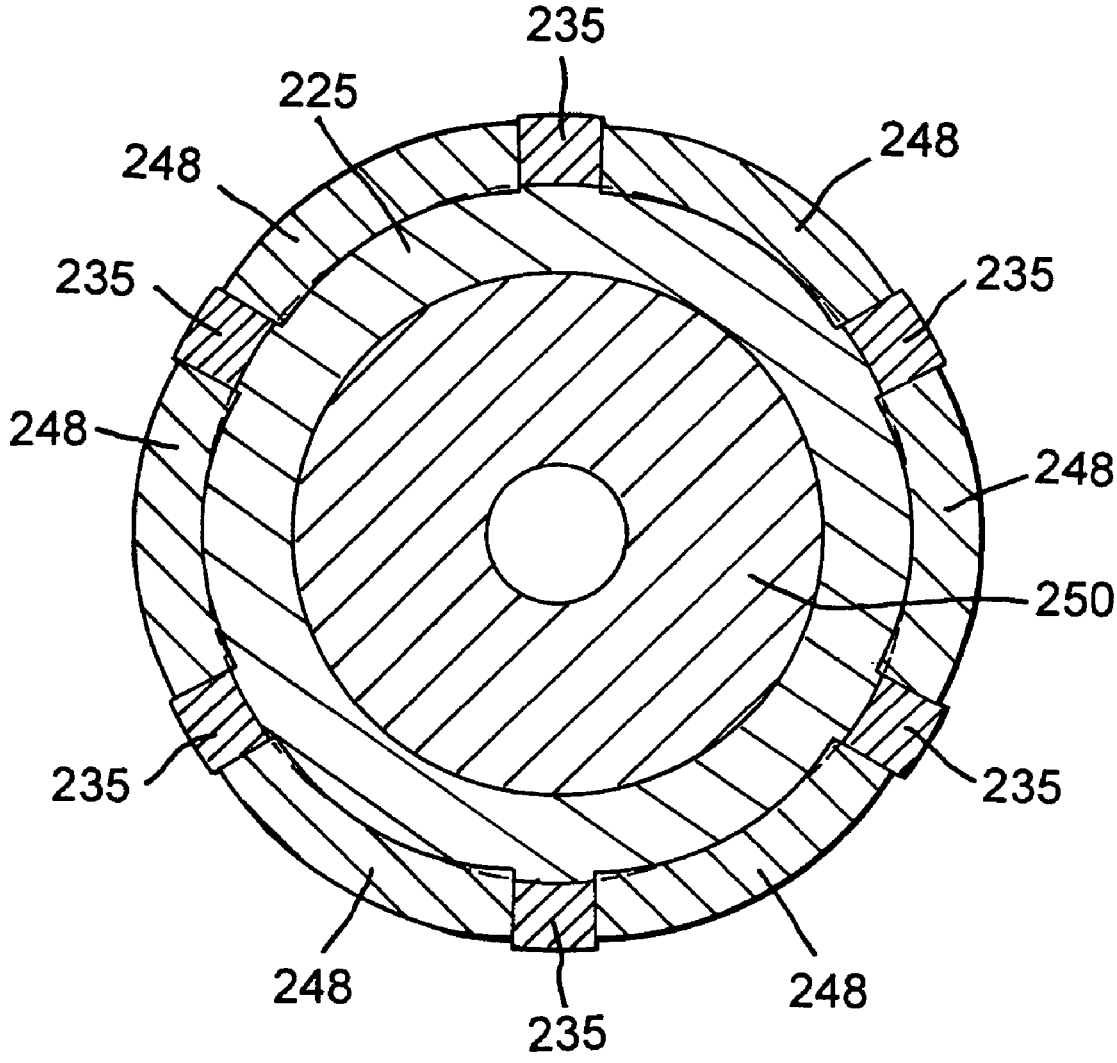
FIG. 7 is a cross sectional view along lines B—B of FIG. 6.

Axial movement of the cones 320, 325 transfers force to the support rings 240, 245. As explained above, the opposing forces cause the support rings 240, 245 to move across the tapered first section of the expansion rings 230, 235. As the support rings 240, 245 move axially, the first section of the support rings 240, 245 expands radially from the mandrel 250 while the wedges 248 hinge radially toward the surrounding tubular. At a pre-determined force, the wedges 248 break away or separate from the first section 242 of the support rings 240, 245. The wedges 248 then extend radially outward to engage the surrounding tubular 700. The compressive force causes the expansion rings 230, 235 to flow and expand as they are forced across the tapered section of the cones 220, 225. As the expansion rings 230, 235 flow and expand, the rings 230, 235 fill the gaps or voids between the wedges 248 of the support rings 240, 245, as shown in FIG. 7. FIG. 7 is a cross sectional view along lines B—B of FIG. 6.

Referring again to FIGS. 6 and 6A, the growth of the expansion rings 230, 235 applies a collapse load through the cones 220, 225 on the mandrel 301, which helps prevent slippage of the element system 200 once activated. The cones 220, 225 then transfer the axial force to the sealing member 210 which is compressed and expanded radially to seal an annulus formed between the mandrel 301 and an inner diameter of the surrounding tubular 700.

In addition to frac-plugs as described above, the non-metallic element system 200 described herein may also be used in conjunction with any other downhole tool used for sealing an annulus within a wellbore, such as bridge plugs or packers, for example. Moreover, while foregoing is directed to the preferred embodiment of the present invention, other and further embodiments of the invention may be devised without departing from the basic scope thereof, and the scope thereof is determined by the claims that follow.

What is claimed is:

1. A downhole tool comprising:

at least one composite component disposed about a mandrel, wherein the component or the mandrel or both are formed by wet winding one or more fibers having a phase angle of from about 30 degrees to about 70 degrees relative to a center line of the tool;

a setting ring disposed about the mandrel;

a plurality of slips disposed axially adjacent to the setting ring to expand radially outward and engage an inner surface of a surrounding tubular;

a support ring disposed adjacent to the setting ring before the tool is set, wherein the support ring has a smaller outer diameter than an inner diameter of the setting ring; and a first and second pair of cones, wherein a member of the second pair of cones is disposed adjacent to the plurality of slips and the second pair of cones is disposed axially bounding the first pair.

2. The tool of claim 1, wherein the one or more fibers pass through a resin bath prior to winding the fibers.

3. The tool of claim 1, wherein the at least one composite component comprises a ring member having two or more tapered wedges.

4. The tool of claim 1. wherein the at least one composite component comprises an annular member having at least one outwardly extending serration disposed on an outer diameter thereof to engage a surrounding tubular.

5. The tool of claim 1, wherein the at least one composite component comprises an annular member having at least one tapered end for engaging a surrounding component.

6. The tool of claim 1, wherein the fibers are wound to a thickness having a desired strength.

7. The tool of claim 1, wherein the fibers are wound to a thickness having a desired stiffness.

8. The tool of claim 1, wherein the fibers comprise glass.

9. The tool of claim 1, wherein the fibers comprise carbon.

10. The tool of claim 1, wherein the fibers comprise one or more aramids.

11. The tool of claim 1, wherein the fibers are wound in the presence of an epoxy resin comprising bisphenol A and epichlomhydrin.

12. The tool of claim 1, wherein the fibers are wound in the presence of a resin blend comprising one or more cycloaliphatic epoxy resins.

13. The tool of claim 1, wherein the fibers are wound in the presence of an epoxy resin blend comprising bisphenol A, epichlorohydrin, and one or more cycloaliphatic epoxy resins.

14. The tool of claim 1, wherein the downhole tool is a frac-plug.

15. The tool of claim 1, wherein the downhole tool is a packer.

16. The tool of claim 1, wherein the downhole tool is a bridge plug.

17. The tool of claim 1, wherein a first end of the setting ring has a flat surface to abut a setting tool.

18. A downhole tool comprising:

a mandrel;

a setting ring disposed about the mandrel;

a plurality of slips disposed axially adjacent to the setting ring to expand radially outward and engage an inner surface of a surrounding tubular;

a support ring disposed adjacent to the setting ring before the tool is set, wherein the support ring has a smaller outer diameter than an inner diameter of the setting ring;

a first and second air of cones, wherein a member of the second air of cones is disposed adjacent to the plurality of slips and the second pair of cones is disposed axially bounding the first pair; and at least one composite component made by a process comprising:

winding a first layer of fibers at an angle of from about 30 degrees to about 70 degrees relative to a center line of the component;

winding a second layer of fibers at an angle of from about 30 degrees to about 70 degrees relative to the center line of the component over at least a portion of the first layer; and winding one or more additional layers of fibers at an angle of from about 30 degrees to about 70 degrees relative to the center line of the component to provide a desired thickness;

wherein each layer is wet wound with an epoxy resin.

19. The tool of claim 18, wherein the second layer is wound at a second angle of from about 30 degrees to about 70 degrees relative to the center line of the component.

20. The tool of claim 18, wherein the fibers of each layer are at least substantially parallel to one another.

21. The tool of claim 18, wherein the fibers of each layer are parallel to one another.

22. The tool of claim 18, wherein the at least one composite component comprises a ring member having two or more tapered wedges.

23. The tool of claim 18, wherein the at least one composite component comprises an annular member having at least one outwardly extending serration disposed on an outer diameter thereof to engage a surrounding tubular.

24. The tool of claim 18, wherein the at least one composite component comprises an annular member having at least one tapered end for engaging a surrounding component.

25. The tool of claim 18, wherein the fibers comprise glass.

26. The tool of claim 18, wherein the fibers comprise carbon.

27. The tool of claim 18, wherein the fibers comprise one or more aramids.

28. The tool of claim 18, wherein the epoxy resin comprises bisphenol A and epichlorohydrin.

29. The tool of claim 18, wherein the epoxy resin is a blend comprising one or more cycloaliphatic epoxy resins.

30. The tool of claim 18, wherein the epoxy resin is a blend comprising bisphenol A, epichlorohydrin, and one or more cycloaliphatic epoxy resins.

31. The tool of claim 18, further comprising curing the layers.

32. The tool of claim 18, further comprising curing the layers using thermal energy.

33. The tool of claim 18, further comprising curing the layers using ultraviolet light.

34. The tool of claim 18, further comprising curing the layers using a high energy electron beam.

35. The tool of claim 18, wherein the downhole tool is a frac-plug.

36. The tool of claim 18, wherein the downhole tool is a packer.

37. The tool of claim 18, wherein the downhole tool is a bridge plug.

38. The tool of claim 1, wherein the support ring is secured to the mandrel by a plurality of pins.

39. The tool of claim 18, wherein a first end of the setting ring has a flat surface to abut a setting tool.

40. The tool of claim 18, wherein the support ring is secured to the mandrel by a plurality of pins.

41. A method of using a down hole tool comprising:

running the tool into a wellbore to a predetermined depth, the tool comprising:

at least one component formed by wet winding one or more fibers having a phase angle of from about 30 degrees to about 70 degrees relative to a center line of the tool;

a mandrel;

a setting ring disposed about the mandrel a plurality of slips disposed axially adjacent to the setting ring to expand radially outward and engage an inner surface of a surrounding tubular;

a support ring disposed adjacent to the selling ring before the tool is set, wherein the support ring has a smaller outer diameter than an inner diameter of the selling ring; and a first and second pair of cones, wherein a member of the second pair of cones is disposed adjacent to the plurality of slips and the second pair of cones is disposed axially bounding the first pair;

setting the tool in the wellbore;

utilizing the tool to isolate the wellbore thereabove from the wellbore therebelow; and releasing the tool from the wellbore by drilling.

42. The method of claim 41, wherein the at least one component formed is formed by;

winding a first layer of fibers at an angle of from about 30 degrees to about 70 degrees relative to a center line of the component;

winding a second layer of fibers at an angle of from about 30 degrees to about 70 degrees relative to the center line of the component over at least a portion of the first layer; and winding one or more additional layers of fibers at an angle of from about 30 degrees to about 70 degrees relative to the center line of the component to provide a desired thickness;

wherein each layer is wet wound with an epoxy resin.

* * * * *

UNITED STATES PATENT AND TRADEMARK OFFICE

CERTIFICATE OF CORRECTION

PATENT NO. : 7,124,831 B2
APPLICATION NO. : 11/101855
DATED : October 24, 2006
INVENTOR(S) : Rocky A. Turley et al.

It is certified that error appears in the above-identified patent and that said Letters Patent is hereby corrected as shown below:

In the Claims section:

Column 9, Claim 18, line 11, please delete "air" and insert --pair--.

Column 9, Claim 18, line 12, please delete "air" and insert --pair--.

Column 10, Claim 41, line 32, please delete "selling" and insert --setting--.

Column 10, Claim 41, line 35, please delete "selling" and insert --setting--.

Signed and Sealed this

Tenth Day of April, 2007

JON W. DUDAS
*Director of the United States Patent and Trademark Office*

UNITED STATES PATENT AND TRADEMARK OFFICE

CERTIFICATE OF CORRECTION

PATENT NO. : 7,124,831 B2
APPLICATION NO. : 11/101855
DATED : October 24, 2006
INVENTOR(S) : Rocky A. Turley et al.

It is certified that error appears in the above-identified patent and that said Letters Patent is hereby corrected as shown below:

In column 8, Claim 1, line 23, please delete “inner” and insert --outer--.

In column 9, Claim 18, line 9, please delete “inner” and insert --outer--.

In column 10, Claim 41, line 34, please delete “inner” and insert --outer--.

Signed and Sealed this

Twenty-first Day of July, 2009

John Doll

JOHN DOLL
*Acting Director of the United States Patent and Trademark Office*